United States Patent [19]

Vernon

[11] Patent Number: 5,039,041

[45] Date of Patent: Aug. 13, 1991

[54] DEVICE FOR HOLDING A BAG

[76] Inventor: Michael O. Vernon, 4395 Deer Run, Evans, Ga. 30809

[21] Appl. No.: 538,419

[22] Filed: Jun. 15, 1990

[51] Int. Cl.[5] ..... B65B 67/04

[52] U.S. Cl. ..... 248/99; 248/100

[58] Field of Search ..... 248/95, 99, 100; 220/1 T, 404; 206/806

[56] References Cited

U.S. PATENT DOCUMENTS

| | | | |
|---|---|---|---|
| 1,431,726 | 10/1922 | Cupples | 248/95 |
| 2,471,309 | 5/1949 | Chandler | 248/99 |
| 2,637,918 | 5/1953 | Mayhew | 248/99 |
| 3,632,029 | 1/1972 | Sonner | 248/95 |
| 3,779,496 | 12/1973 | Welles | 248/99 |
| 3,794,280 | 2/1974 | Atkin | 248/99 |
| 4,052,764 | 10/1977 | Groff | 15/257.9 |
| 4,461,442 | 7/1984 | Keenan | 248/95 |
| 4,669,689 | 6/1987 | Jones | 248/99 |
| 4,749,011 | 6/1988 | Rylander | 141/316 |
| 4,775,123 | 10/1988 | Borland et al. | 248/99 |

*Primary Examiner*—Carl D. Friedman
*Assistant Examiner*—Korie H. Chan
*Attorney, Agent, or Firm*—Walker & McKenzie

[57] ABSTRACT

A device for being attached to a support member and for holding a sandwich-type bag with the mouth of the bag held open to allow trash and the like to be easily inserted into the bag. The device includes a base member for being attached to the support member; and a tab member attached to the base member for extending into the cuff of the bag to hold the bag to the device.

6 Claims, 1 Drawing Sheet

DEVICE FOR HOLDING A BAG

BACKGROUND OF THE INVENTION

1. Field of the Invention

The present invention relates, in general, to means for holding bags and the like in a ready-to-use position.

2. Information Disclosure Statement

A preliminary patentability search conducted in class 248, subclass 99 produced the following patents: Welles, U.S. Pat. No. 3,779,496; Atkin, U.S. Pat. No. 3,794,280; Groff, U.S. Pat. No. 4,052,764; Jones, U.S. Pat. No. 4,669,689; Rylander, U.S. Pat. No. 4,749,011; and Borland et al., U.S. Pat. No. 4,775,123.

Welles discloses a generally U-shaped device for being secured to the open mouth of a flexible bag or the like to hold the mouth of the bag open. The U-shaped device may include slits for receiving a portion of the bag to secure the bag to the device.

Atkin discloses an apparatus for holding the mouth of a plastic bag or the like open and positioned directly beneath a fly-tying vise. The apparatus includes a metal rod being in a generally rectangular loop about which the open mouth of the plastic bag is secured.

Groff discloses a device for holding the mouth of a paper grocery bag open. The device includes a ramp or scoop to allow refuse or the like to be swept into the bag, includes a hanger for allowing the open bag to be hung from a wall or the like, and includes projections for extending through the wall of the bag to hold the bag secure to the device.

Jones discloses a device for holding open the mouth of a plastic bag having a pair of handle loops. The device includes a pair of spaced apart protuberances for receiving the handle loops of the bag Rylander discloses a device that can be rolled in a substantially cylindrical configuration and inserted into the mouth of a plastic bag. When the device is released, it will spring open to thereby hold the mouth of the bag in an open position.

Borland et al. discloses a device for holding the mouth of a plastic bag open. The device consists of a hoop about which the mouth of a plastic bag is secured by pressing a portion of the plastic bag through an aperture in the hoop and pulling the portion of the plastic bag that is pressed through the aperture into a slot in the hoop.

The inventor is aware of large metal supports used on golf courses for large garbage bags or the like.

The inventor is also aware of the practice used by many dentists of merely taping plastic bags to a counter top to collect trash and the like.

None of the above patents disclose or suggest the present invention. More specifically, none of the above patents disclose or suggest a bag holding device including a base member for being attached to a support member, and a tab member attached to the base member for extending into a cuff of a bag to hold the bag to the device. The inventor is not aware of any support for a flap-type sandwich bags or of such flap-type sandwich bags being used for trash collection.

SUMMARY OF THE INVENTION

The present invention is directed toward providing a device for holding a bag of the type having an open mouth with a cuff extending about at least a portion of the mouth. The device of the present invention includes a base member for being attached to a support member, and a tab member attached to the base member for extending into the cuff of the bag to hold the bag to the device.

One object of the present invention is to provide a convenient receptacle for trash or other items that need to be packaged in a bag for storage or disposal.

Another object of the present invention is to provide means for being mounted to the underside of a counter top or the like to hold a bag in a ready to use position adjacent the edge of the counter top or the like.

Another object of the present invention is to provide means for holding typical plastic flap-type sandwich bags in a ready to use position to allow small pieces of trash or other items that need to be packaged to be inserted into a bag.

Another object of the present invention is to provide a holder especially useful for dental procedures and the like for allowing a typical plastic flap-type sandwich bag to be hung on a counter top adjacent a dental chair or the like before a dental procedure or the like by means of the pouch of the bag formed by the flap, for allowing a dentist or the like to easily insert trash or other items that need to be packaged into the interior of the bag, and for allowing the bag to be easily removed from the holder and closed by merely folding the flap of the bag over the open top of the bag in the typical manner after the procedure is finished to allow the bag to be thrown away or stored for later use. Such a combination is much more convenient and quicker to use than the present practice used by many dentists of taping a bag to a counter top. Such a combination, when used properly, satisfies requirements to segregate infected waste.

DESCRIPTION OF THE PREFERRED EMBODIMENT

Figure 1:
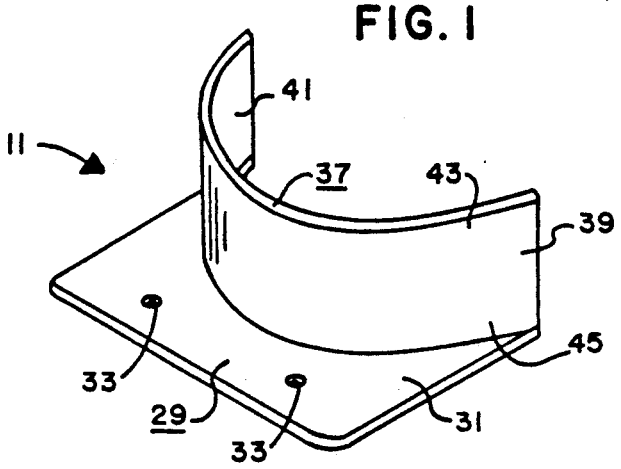
FIG. 1 is a perspective view of the device of the present invention.

The device 11 of the present invention is for being attached to a support member 13. The support member 13 may consist of a table top, a counter top, etc., and preferably includes a lower surface 15, an upper surface 17, and a side edge 19. The device 11 is used to hold a bag 21 relative to the support member 13. The bag 21 preferably consists of any typical plastic flap-type sandwich bag well known to those skilled in the art having a mouth 23 and a cuff 25 adjacent to at least a portion of the mouth 23. More specifically, the bag 21 preferably has an open mouth 23 with the cuff 25 extending across a first half or side of the mouth 23 and with an extension or flap 27 extending from the second half or side of the mouth 23. The opposite ends of the cuff 25 are attached to the opposite sides of the bag 21 to form a pouch 28 or the like.

The device 11 includes a mounting plate or base member 29 for being attached to the support member 13. The base member 29 has an upper surface 31 for being attached to the lower surface 15 of the support member 13. More specifically, the base member 29 preferably consists of a substantially flat plate with a pair of apertures 33 therethrough for allowing a pair of screws 35 (only one being shown in the drawings) to be used to secure the base member 29 to the lower surface 15 of the support member 13 as will now be apparent to those skilled in the art. The specific construction of the base member 29 can be varied for attachment to various specific surfaces, etc., as will now be apparent to those skilled in the art.

Figure 2:
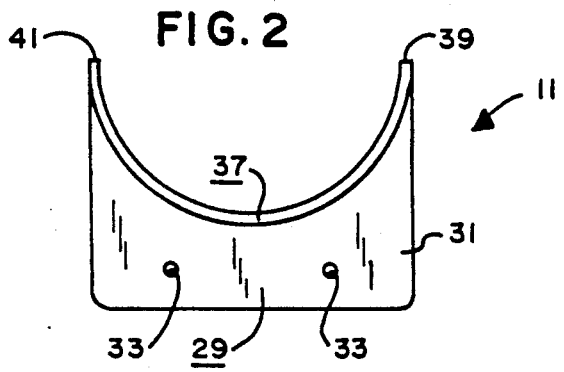
FIG. 2 is a top plan view of the device of the present invention.
Figure 3:
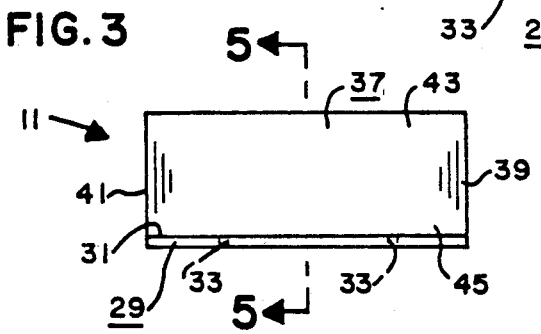
FIG. 3 is a front view of the device of the present invention.
Figure 4:
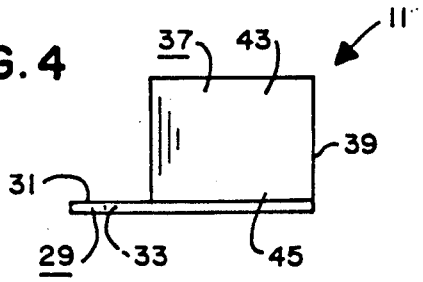
FIG. 4 is a right end view the device of the present invention.

The device 11 includes a tab member 37 attached to the base member 29 for extending into the pouch 28 of the bag 21 to hold the bag 21 to the device 11. The tab member 37 preferably has a first end 39 and a second end 41, and is preferably curved between the first and second ends 39, 41 as clearly shown in FIGS. 1 and 2. The tab member 37 preferably has an upper end 43 and a lower end 45 with the lower end 45 being attached to the base member 29. The height of the tab member 37, that is, the distance between the upper end 43 and the lower end 45 of the tab member 37, is no greater, and preferably slightly less, than the distance between the lower surface 15 and the upper surface 17 of the support member 13 for reasons which will hereinafter become apparent.

The base member 29 and tab member 37 may be constructed in various manners and out of various materials as will now be apparent to those skilled in the art. Preferably, the base member 29 and tab member 37 are molded or otherwise constructed as an integral, one-piece unit out of a synthetic resin material such as Plexiglas or the like. However, the base member 29 may be cut from a flat piece of Plexiglas or the like with a curve cut into one edge and with the apertures 33 drilled or otherwise formed therein, and the tab member 37 may consist of a strap of Plexiglas or the like curved into a half circle and attached to the base member 29 adjacent the curve cut into one edge of the base member 29 using glue or the like.

Figure 5:
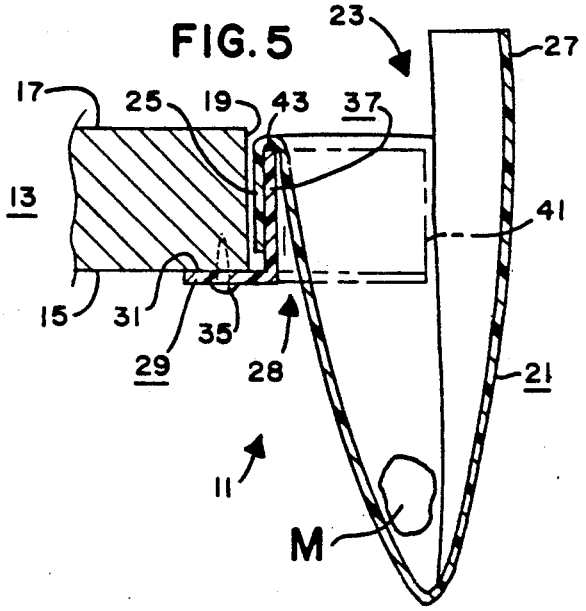
FIG. 5 is a sectional view as taken on line 5—5 of FIG. 3 with the device of the present invention shown attached to a support member and with a bag shown attached to the device of the present invention.

The device 11 is attached to the lower surface 15 of the support member 13 with the tab member 37 positioned adjacent but slightly spaced from the side edge 19 of the support member 13 as clearly shown in FIG. 5 to allow the cuff 25 of the bag 21 to fit between the tab member 37 and the side edge 19 of the support member 13. With the device 11 so attached to the support member 13, a bag 21 can be easily attached to the device 11 by merely inserting the cuff 25 of the bag 21 over the tab member 37. The curved or arcuate shape of the tab member 37 will cause the mouth 23 of the bag 21 to be held at least partially open to allow material M such as trash or the like to be easily placed into the interior of the bag 21. With the upper edge 43 of the tab member 37 and, thus, the top of the cuff 25 of the bag 21, located slightly below the upper surface 17 of the support member 13, it will be extremely easy to slide or otherwise move material M from the upper surface 17 of the support member 13, through the mouth 23 of the bag 21, and into the interior of the bag 21 as will now be apparent to those skilled in the art. When it is desired to remove the bag 21 from the device 11, the cuff 25 of the bag 21 is merely lifted off the tab member 37. The flap 27 of the bag 21 can then be folded into the interior of the bag 21 on top of the material M, and the cuff 25 inverted over the mouth 23 of the bag 21 in the typical manner now apparent to those skilled in the art to seal the material M within the interior of the bag 21.

As thus constructed and used, the device 11 of the present invention provides a holder for plastic flap-type sandwich bags that is especially useful in dental offices and the like. However, many other uses for the device 11 will now become apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A device for being attached to a support member and for holding a bag, said bag including a main compartment having a mouth and including a cuff extending across at least a portion of said mouth for forming a downwardly opening pouch adjacent to at least a portion of said mouth; said device comprising:

a) a base member comprising a substantially flat plate for being attached to said support member; and b) a tab member attached to said base member and extending upwardly therefrom for extending upwardly into said pouch of said bag to hold said bag to said device and to hold said mouth of said bag open, said tab member having an upper end and a lower end and being curved partially around a longitudinal axis extending between said lower end and said upper end of said tab member to form a curved means for being inserted into said pouch of said bag and for holding said mouth of said bag open when said tab member extends into said pouch of said bag.

2. The device of claim 1 in which said tab member has a first end edge extending between said upper and lower ends and a second end.

3. The device of claim 2 in which said lower end of said tab member is attached to said base member.

4. The device of claim 3 in which said support member has a lower surface and a side edge; and in which said base member has an upper surface for being attached to said lower surface of said support member with said tab member positioned adjacent said side edge of said support member.

5. The device of claim 4 in which said support member has an upper surface; and in which the distance between said upper end and said lower end of said tab member is no greater than the distance between said lower surface and said upper surface of said support member.

6. The combination of a device and a bag adapted to be supported by said device for attachment to a support member having an upper surface, a lower surface, and a side edge; said bag having a mouth and a pouch extending across a portion of said mouth for being folded over the remainder of said mouth when it is desired to close said mouth of said bag; said device comprising:

a) a base member comprising a substantially flat plate attached to said support member; said base member having an upper surface attached to said lower surface of said support member; and b) a tab member attached to said base member and extending upwardly therefrom for extending upwardly into said pouch of said bag to hold said bag to positioned adjacent said side edge of said support member; said tab member having a first end edge and a second end edge and being curved between said first and second end edges; said tab member having an upper end and a lower end, said lower end of said tab member being attached to said base member; the distance between said upper end and said lower end of said tab member being no greater that the distance between said lower surface and said upper surface of said support member.

* * * * *